US012378760B2

(12) United States Patent
Subacchi

(10) Patent No.: US 12,378,760 B2
(45) Date of Patent: Aug. 5, 2025

(54) PREFABRICATED BUILDING STRUCTURE

(71) Applicant: CSCON S.r.l., Piacenza (IT)

(72) Inventor: Claudio Subacchi, Piacenza (IT)

(73) Assignee: CSCON S.r.l., Piacenza (IT)

( * ) Notice: Subject to any disclaimer, the term of this patent is extended or adjusted under 35 U.S.C. 154(b) by 0 days.

(21) Appl. No.: 18/685,020

(22) PCT Filed: Aug. 5, 2022

(86) PCT No.: PCT/IB2022/057311
§ 371 (c)(1),
(2) Date: Feb. 20, 2024

(87) PCT Pub. No.: WO2023/042003
PCT Pub. Date: Mar. 23, 2023

(65) Prior Publication Data

US 2024/0263436 A1 Aug. 8, 2024

(30) Foreign Application Priority Data

Sep. 15, 2021 (IT) ..... 102021000023723

(51) Int. Cl.
*E04B 1/21* (2006.01)
*E04B 1/00* (2006.01)

(52) U.S. Cl.
CPC ..... *E04B 1/21* (2013.01); *E04B 1/215* (2013.01)

(58) Field of Classification Search
CPC ..... E04B 1/21
(Continued)

(56) References Cited

U.S. PATENT DOCUMENTS 2,100,451 A * 11/1937 Parkhurst ..... E04B 1/21 52/583.1
3,378,971 A * 4/1968 Singer ..... E04B 1/24 52/236.7

(Continued)

FOREIGN PATENT DOCUMENTS

CN 103074941 A * 5/2013
CN 105625570 A * 6/2016 ..... E04B 1/21

(Continued)

OTHER PUBLICATIONS

International Search Report and Written Opinion for International Application No. PCT/IB2022/057311 (ISA/EP) mailed Sep. 6, 2022 (10 pages).

(Continued)

*Primary Examiner* — Brian D Mattei
*Assistant Examiner* — Joseph J. Sadlon
(74) *Attorney, Agent, or Firm* — ALSTON & BIRD LLP

(57) ABSTRACT

A prefabricated building structure, comprising: —a first and a second pillar (21, 22) reciprocally stacked and having a preponderant longitudinal extension direction (20); an upper end (211) of the first pillar (21) being located at a lower end (221) of the second pillar (22); —a beam (3) extending substantially horizontally and having a first end (31) located at said upper end (211) and said lower end (221); —reciprocal fixing means (9) for reciprocally fixing the first pillar (21), the second pillar (22) and the beam (3); said reciprocal fixing means (9) being able to be at least partly incorporated in the first pillar (21), in the second pillar (22), in the beam (3). The reciprocal fixing means (9) comprises projecting means (91) and corresponding housing means (92) in which the projecting means (91) fits defining a joint. The projecting means (91) and the housing means (92) define male-female (Continued)

connections both between the first pillar (21) and the beam (3) and between the second pillar (22) and the beam (3).

9 Claims, 7 Drawing Sheets

(58) Field of Classification Search
USPC ..... 52/742.1
See application file for complete search history.

(56) References Cited

U.S. PATENT DOCUMENTS 3,429,092 A * 2/1969 Hart ..... E04B 1/20 52/236.7
3,513,610 A * 5/1970 Devonport ..... B28B 23/00 52/283
3,562,978 A * 2/1971 Ali-Oglu ..... E04B 1/215 52/263
3,594,971 A * 7/1971 Hughes ..... E04B 1/215 52/432
3,604,177 A * 9/1971 Clyne ..... E04B 1/21 52/781.5
3,702,523 A * 11/1972 McCaul, III ..... E04B 1/21 52/742.16
3,760,736 A * 9/1973 Eig ..... F42B 14/02 102/527
3,780,480 A * 12/1973 Cvijanovic ..... E04B 1/215 52/587.1
3,999,735 A * 12/1976 Brownlee ..... E04B 1/215 249/19
4,005,233 A * 1/1977 Dritt ..... B65H 54/64 220/591
4,819,394 A * 4/1989 Compton ..... E04B 1/215 52/252
5,392,580 A * 2/1995 Baumann ..... E04C 5/04 52/646
5,556,673 A * 9/1996 Giraud ..... B29C 70/865 428/34.4
5,688,069 A * 11/1997 Hoshino ..... E04B 1/215 403/339
6,290,021 B1 * 9/2001 Strandgaard ..... B63B 3/68 181/290
6,370,836 B1 * 4/2002 Gunn ..... B25B 1/205 81/46
6,679,017 B2 * 1/2004 Woodruff, III ..... E04B 1/215 403/360
7,882,669 B2 * 2/2011 Qu ..... E04G 11/18 52/407.4
8,043,982 B2 * 10/2011 Telander ..... B32B 5/022 428/911
8,132,388 B2 * 3/2012 Nagy ..... E04B 1/04 52/261
8,166,717 B2 * 5/2012 Kim ..... E04B 1/30 403/310
8,453,414 B2 * 6/2013 Simmons ..... F16B 9/09 403/231
8,511,038 B2 * 8/2013 Brandstrom ..... E04C 5/07 52/745.03
8,726,589 B2 * 5/2014 Tooman ..... E02D 27/42 405/231
9,003,740 B2 * 4/2015 Ciuperca ..... E04C 2/296 52/745.05
9,033,178 B2 * 5/2015 White ..... F17C 13/025 220/560.07
9,127,449 B2 * 9/2015 Clear ..... E04B 2/24
9,267,283 B1 * 2/2016 Kentz ..... E04B 1/043
9,340,978 B2 * 5/2016 Naito ..... E04G 21/12
9,376,782 B1 * 6/2016 Ehsani ..... E02D 5/00
9,499,984 B2 * 11/2016 Manning ..... E04C 5/012
9,611,644 B2 * 4/2017 Studebaker ..... E04C 5/08
9,637,923 B2 * 5/2017 Radhouane ..... E04C 3/293
9,797,125 B2 * 10/2017 Takahashi ..... E04B 1/2403
10,094,110 B2 * 10/2018 Gomes ..... E04B 2/22
10,106,973 B1 * 10/2018 Sarda ..... E04B 5/043
10,167,623 B2 * 1/2019 Mou ..... E04B 1/58
10,260,225 B2 * 4/2019 Lee ..... E04C 5/0645
10,378,199 B2 * 8/2019 Calderon Uriszar-Aldaca ..... E04B 1/388
10,738,463 B2 * 8/2020 Miller ..... E04B 1/585
10,876,282 B1 * 12/2020 Mou ..... E04B 1/2608
10,907,343 B1 * 2/2021 Mou ..... E04C 3/122
10,914,061 B1 * 2/2021 Mou ..... E04B 1/185
10,961,696 B2 * 3/2021 Mou ..... E04H 9/0237
10,968,631 B2 * 4/2021 Ehsani ..... E04G 23/0218
11,098,476 B2 * 8/2021 Jin ..... E04B 1/2403
11,105,084 B1 * 8/2021 Cui ..... E04C 3/293
11,155,989 B1 * 10/2021 Mou ..... E04B 1/2403
11,225,786 B2 * 1/2022 Yu ..... E04C 3/20
11,686,084 B2 * 6/2023 Chen ..... E04B 1/215 52/745.19
11,781,308 B2 * 10/2023 Boyd ..... E04B 1/1912 52/655.1
12,116,768 B2 * 10/2024 Chen ..... E04B 1/215
2002/0189193 A1 * 12/2002 Faynor ..... E04H 17/161 52/327
2004/0065030 A1 * 4/2004 Zambelli ..... E04B 1/21 52/223.13
2012/0210669 A1 * 8/2012 Lee ..... E04C 5/0645 52/745.19
2013/0014467 A1 * 1/2013 Ehsani ..... E04C 5/07 52/741.1
2013/0152485 A1 * 6/2013 Austin ..... E04B 1/35 52/79.8
2013/0213562 A1 * 8/2013 Ehsani ..... B29C 51/10 156/158
2015/0059926 A1 * 3/2015 Ehsani ..... E02D 5/64 144/330
2016/0007738 A1 * 1/2016 Garcia ..... A47B 55/02 29/897.312
2016/0097192 A1 * 4/2016 Marquina ..... E04B 1/24 52/655.1
2019/0376273 A1 12/2019 Mou et al.
2021/0348377 A1 * 11/2021 Scott ..... E04B 5/43
2021/0348387 A1 * 11/2021 Dombowsky ..... E04C 2/06
2022/0205233 A1 * 6/2022 Curtis ..... E04B 1/28

FOREIGN PATENT DOCUMENTS

CN 106368319 A * 2/2017 ..... E04B 1/043
CN 107366354 A * 11/2017 ..... E04B 1/21
CN 108571070 A * 9/2018 ..... E04B 1/21
CN 109024888 A * 12/2018 ..... E04B 1/21
CN 109296073 A * 2/2019 ..... E04B 1/215
CN 109797909 A * 5/2019
CN 110670722 A * 1/2020 ..... E04B 1/20
CN 111021529 A * 4/2020
CN 111075015 A * 4/2020
CN 111576623 A * 8/2020 ..... E04B 1/215
CN 109386054 B * 10/2020 ..... E04B 1/20
CN 111877642 A * 11/2020
CN 112031158 A * 12/2020 ..... E04B 1/20
CN 112359966 A * 2/2021 ..... E04B 1/20
CN 112523429 A * 3/2021 ..... E04B 1/21
CN 112609817 A * 4/2021 ..... E04B 1/00
CN 112627332 A * 4/2021 ..... E04B 1/20
CN 112031162 B * 8/2021 ..... E02D 27/42
CN 111877548 B * 9/2021 ..... E04B 1/21
DE 19839457 A1 * 3/2000 ..... H01K 1/06
EP 0004998 A2 * 10/1979 ..... E04B 1/21
EP 1132534 A2 * 9/2001 ..... E04B 1/215
EP 3660237 A1 6/2020
FI 83558 B * 4/1991 ..... E04B 1/20
FR 2387325 A1 11/1978
FR 2558506 A1 * 7/1985 ..... E04F 13/045
FR 2902814 A1 * 12/2007 ..... E04B 1/21
GB 2188079 A * 9/1987 ..... E04B 2/18
GB 2494135 A * 3/2013 ..... E04B 1/4178
KR 20090126076 A * 12/2009
KR 101269639 B1 * 5/2013 ..... E04B 1/21
KR 20150033391 A * 4/2015 ..... E04B 1/20
KR 101904204 B1 * 10/2018 ..... E04H 9/027

(56) References Cited

FOREIGN PATENT DOCUMENTS

| | | | | | |
|---|---|---|---|---|---|
| SE | 429987 | B | * | 10/1983 | ..... B29C 70/10 |
| WO | WO-2010037775 | A2 | * | 4/2010 | ..... E04B 1/21 |
| WO | WO-2015011300 | A1 | * | 1/2015 | ..... E04B 1/26 |

OTHER PUBLICATIONS

International Preliminary Report on Patentability (IPEA/EP) completed Jul. 19, 2023 (14 pages).

* cited by examiner

PREFABRICATED BUILDING STRUCTURE

CROSS REFERENCE TO RELATED APPLICATIONS

This application is a National Stage Application, filed under 35 U.S.C. § 371, of International Application No. PCT/IB2022/057311, filed Aug. 5, 2022, which claims priority to Italy Application No. 102021000023723, filed Sep. 15, 2021; the contents of both of which are hereby incorporated by reference in their entirety.

BACKGROUND

Related Field

The present invention relates to a prefabricated building structure.

Description of Related Art

Methods are known which allow the creation of prefabricated structures where the connections between the load-bearing elements can transfer moments. However, these methods become inefficient and very expensive when both vertical and horizontal elements are joined in the nodes. Furthermore, they do not allow an easy vertical insertion of wall elements.

BRIEF SUMMARY

In this context, the technical task underpinning the present invention is to provide a prefabricated building structure which obviates the drawbacks of the prior art as described above.

In particular, it is an object of the present invention to provide a prefabricated building structure which allows to optimise the speed and efficiency of the service while minimising the risk of errors. The stated technical task and specified objects are substantially achieved by a prefabricated building structure comprising the technical features set forth in one or more of the appended claims.

BRIEF DESCRIPTION OF THE FIGURES

Further characteristics and advantages of the present invention will become more apparent from the indicative, and hence non-limiting, description of a preferred, but not exclusive, embodiment of a prefabricated building structure as illustrated in the appended drawings, in which.

DETAILED DESCRIPTION OF VARIOUS EMBODIMENTS

Figure 1:
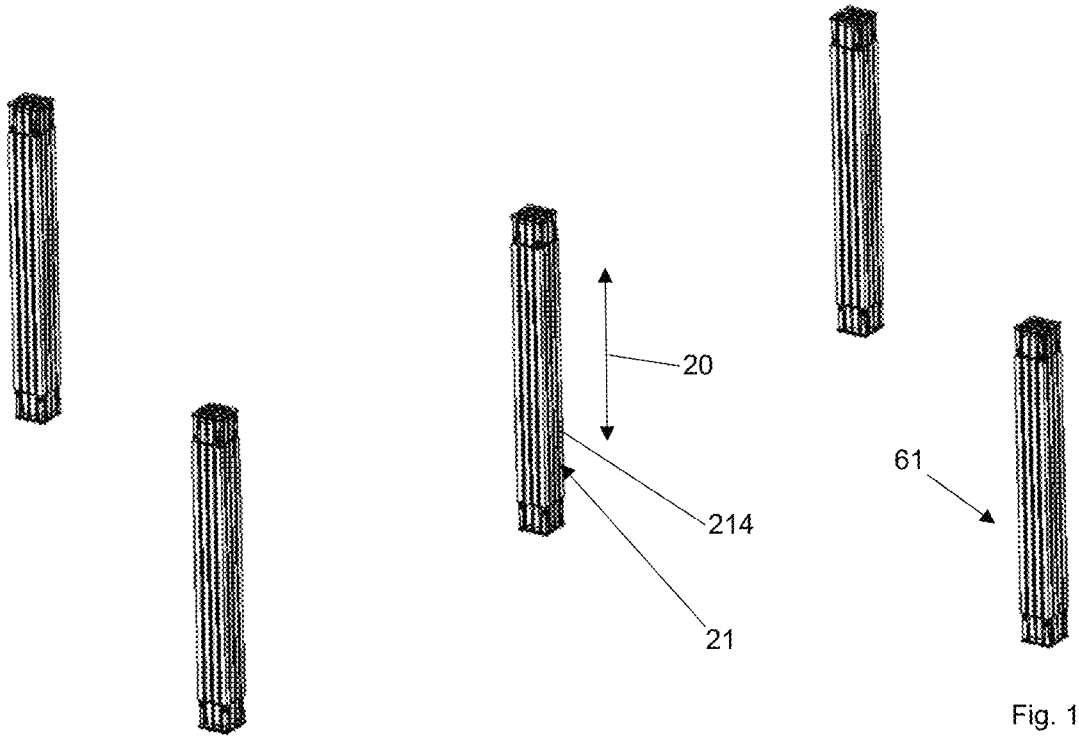
FIGS. 1-9 show a sequence of steps for assembling the building structure.
Figure 2:
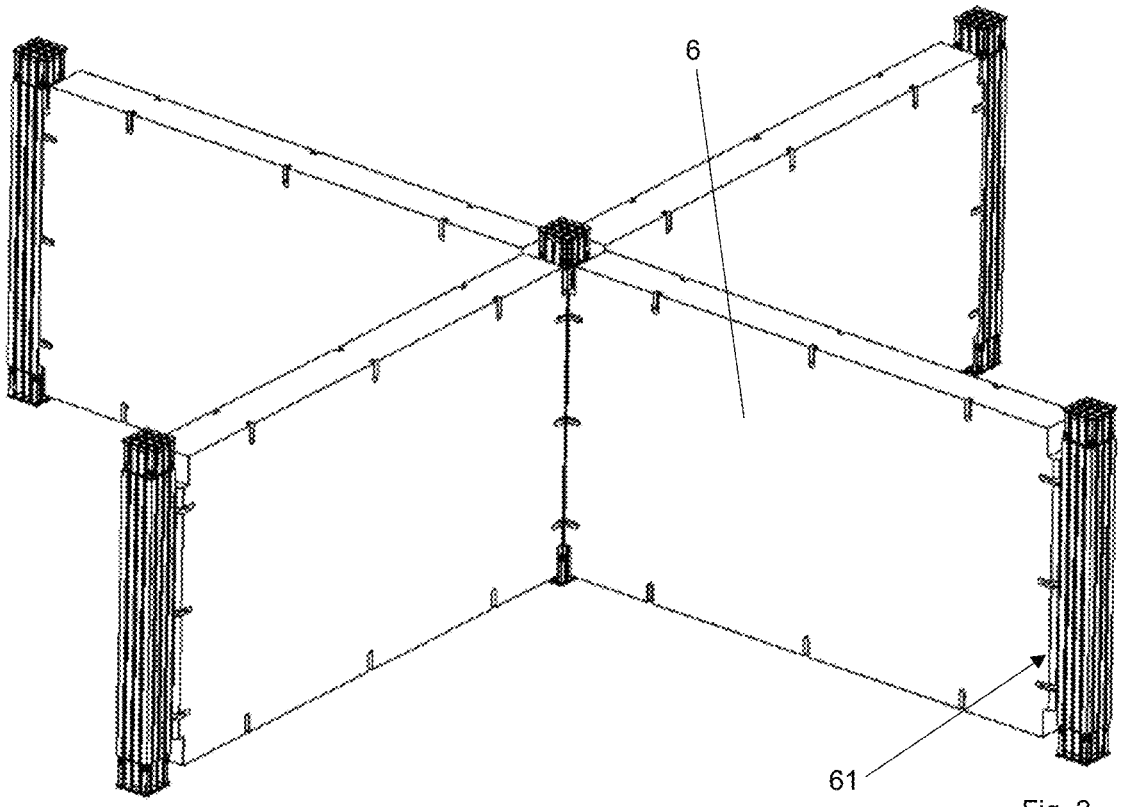
Figure 3:
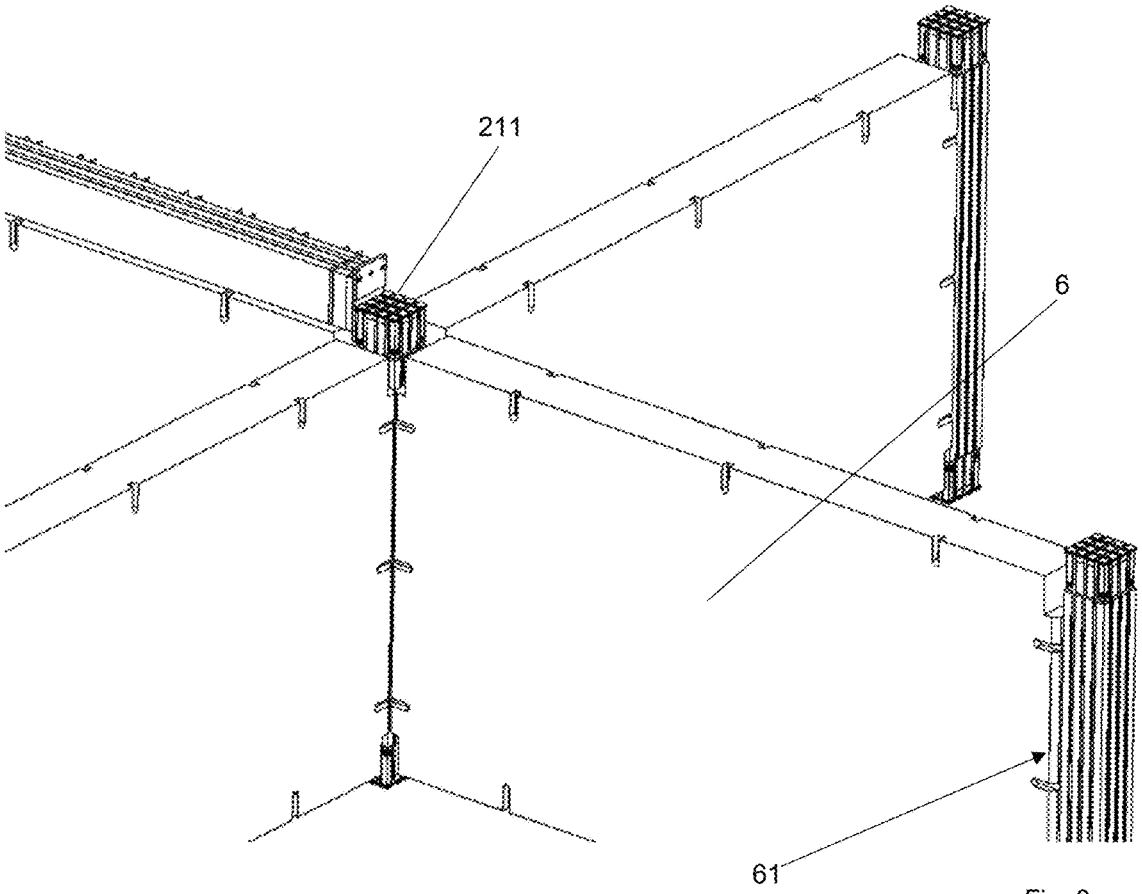
Figure 4:
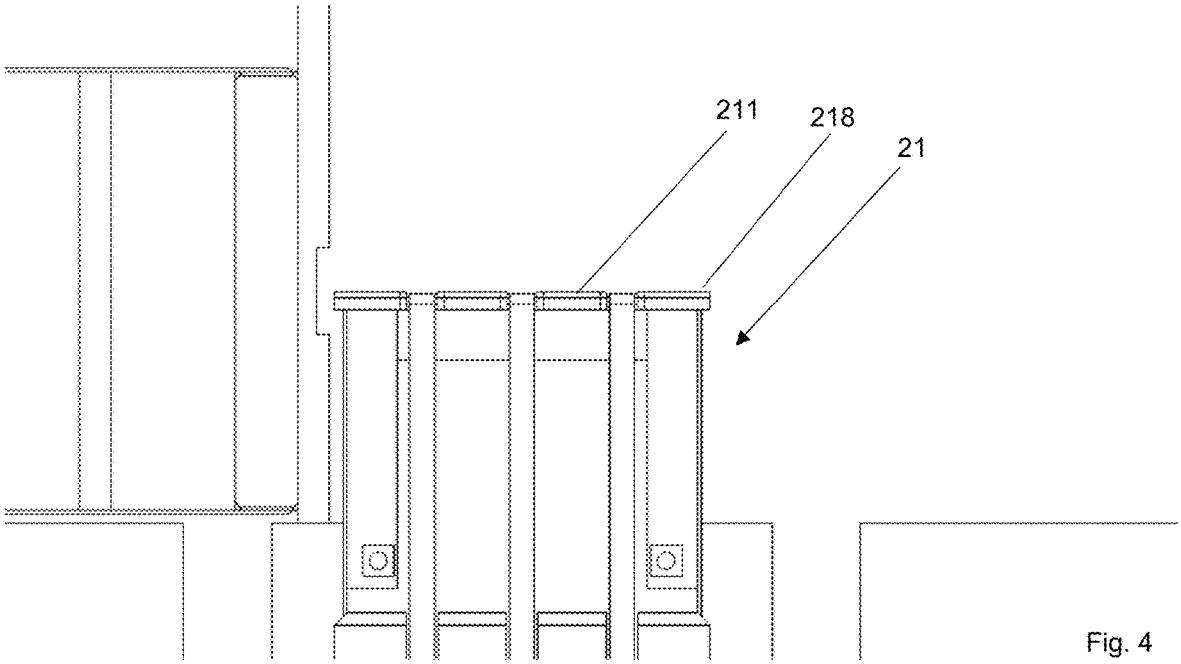
Figure 5:
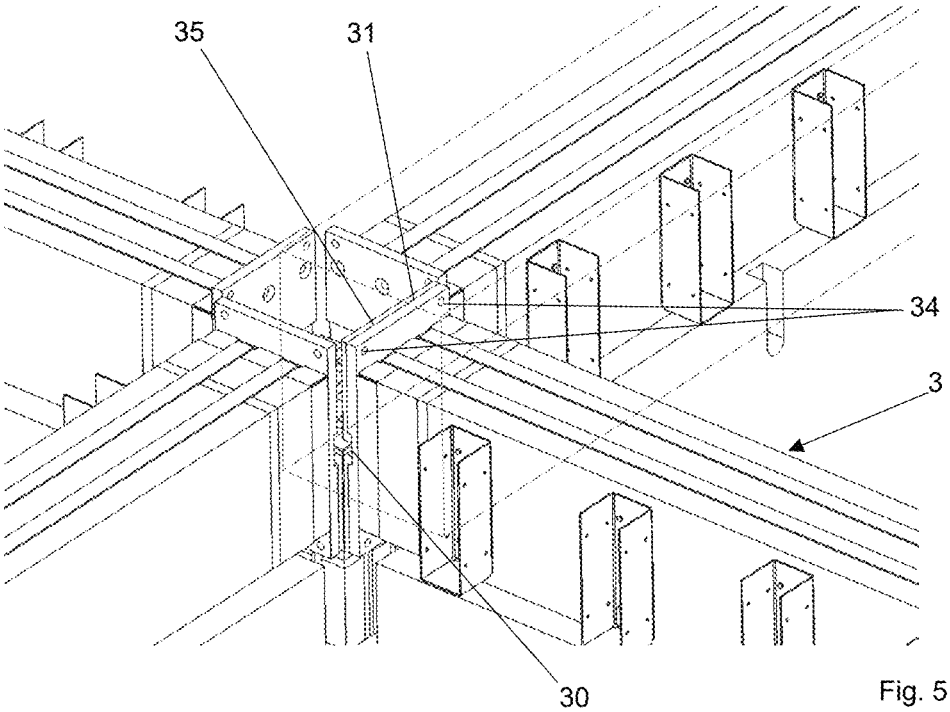
Figure 6:
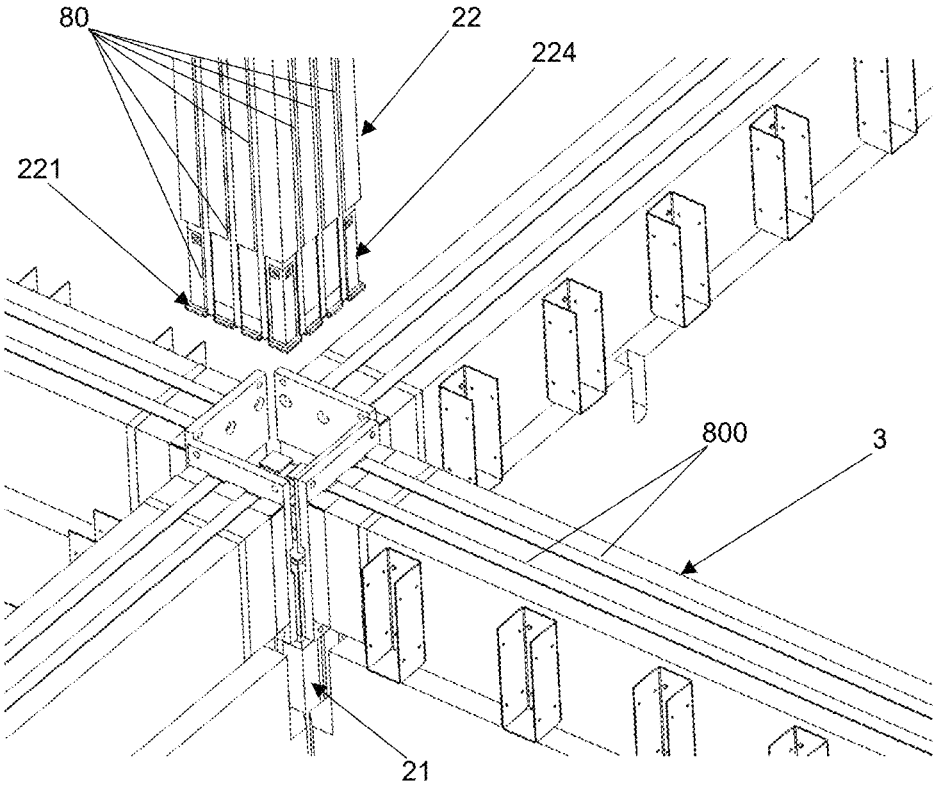

In the appended drawings, reference number 1 indicates a prefabricated building structure. Suitably, it is a prefabricated building structure in concrete. Such a building structure therefore defines a building. It is of the prefabricated type and therefore the assembly of previously-made structural elements occurs on site.

Such a building structure 1 comprises a first and a second pillar 21, 22. The first and the second pillar 21, 22 are reciprocally stacked. They have a preponderant longitudinal extension direction. The first and the second pillar 21, 22 extend preponderantly vertically. They are also stacked vertically.

An upper end 211 of the first pillar 21 is located at a lower end 221 of the second pillar 22. Suitably the upper end 211 and the lower end 221 are facing each other. Suitably the upper end 211 of the first pillar 21 and the lower end 221 of the second pillar 22 are in reciprocal contact. The first pillar 21 is below the second pillar 22.

The structure 1 comprises a beam 3 extending substantially horizontally and has a first end 31 located at said upper end 211 and said lower end 221.

Suitably, the first pillar 21 and/or the second pillar 22 and/or the beam 3 is/are made of concrete.

Figure 9:
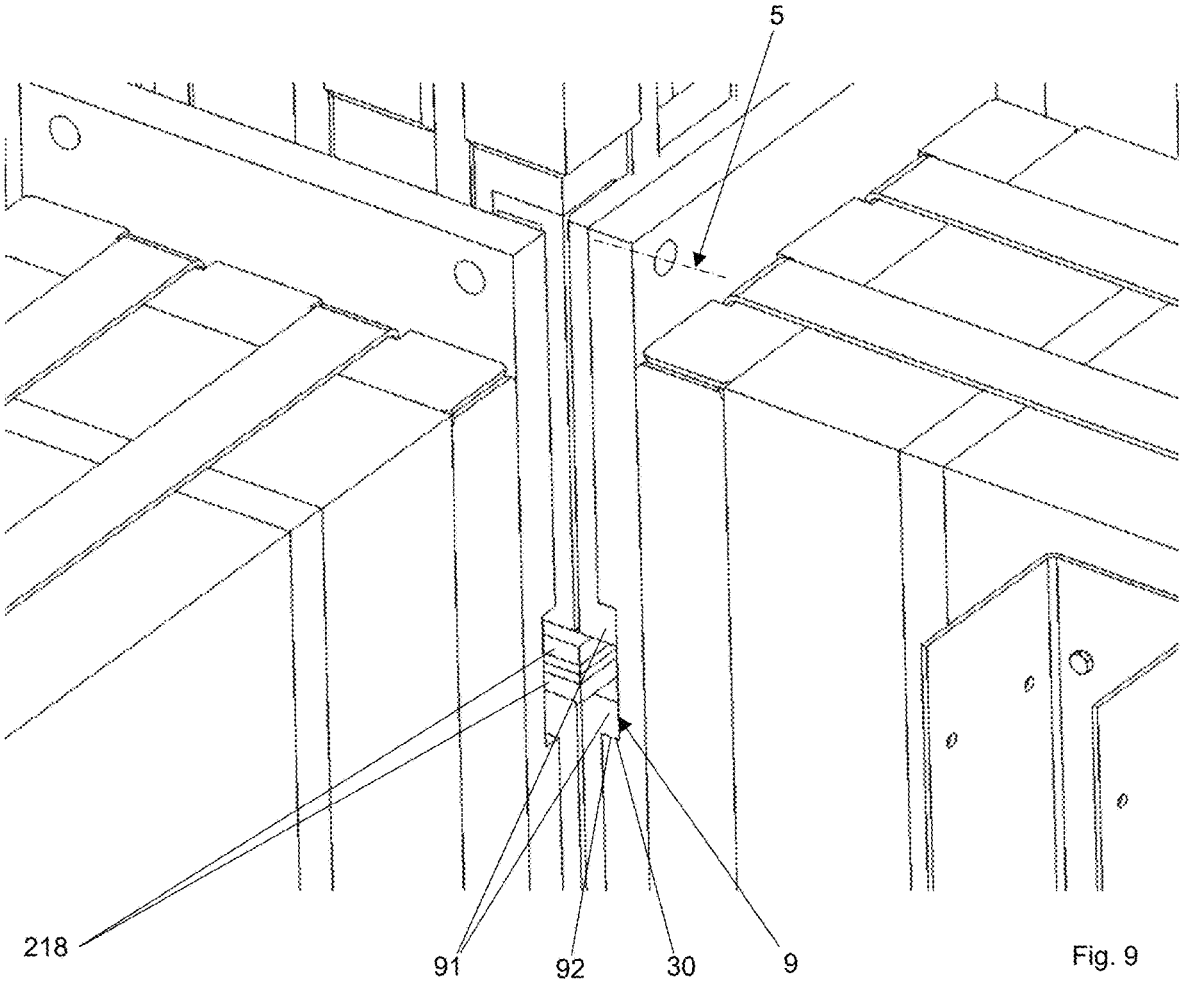
Figure 10:
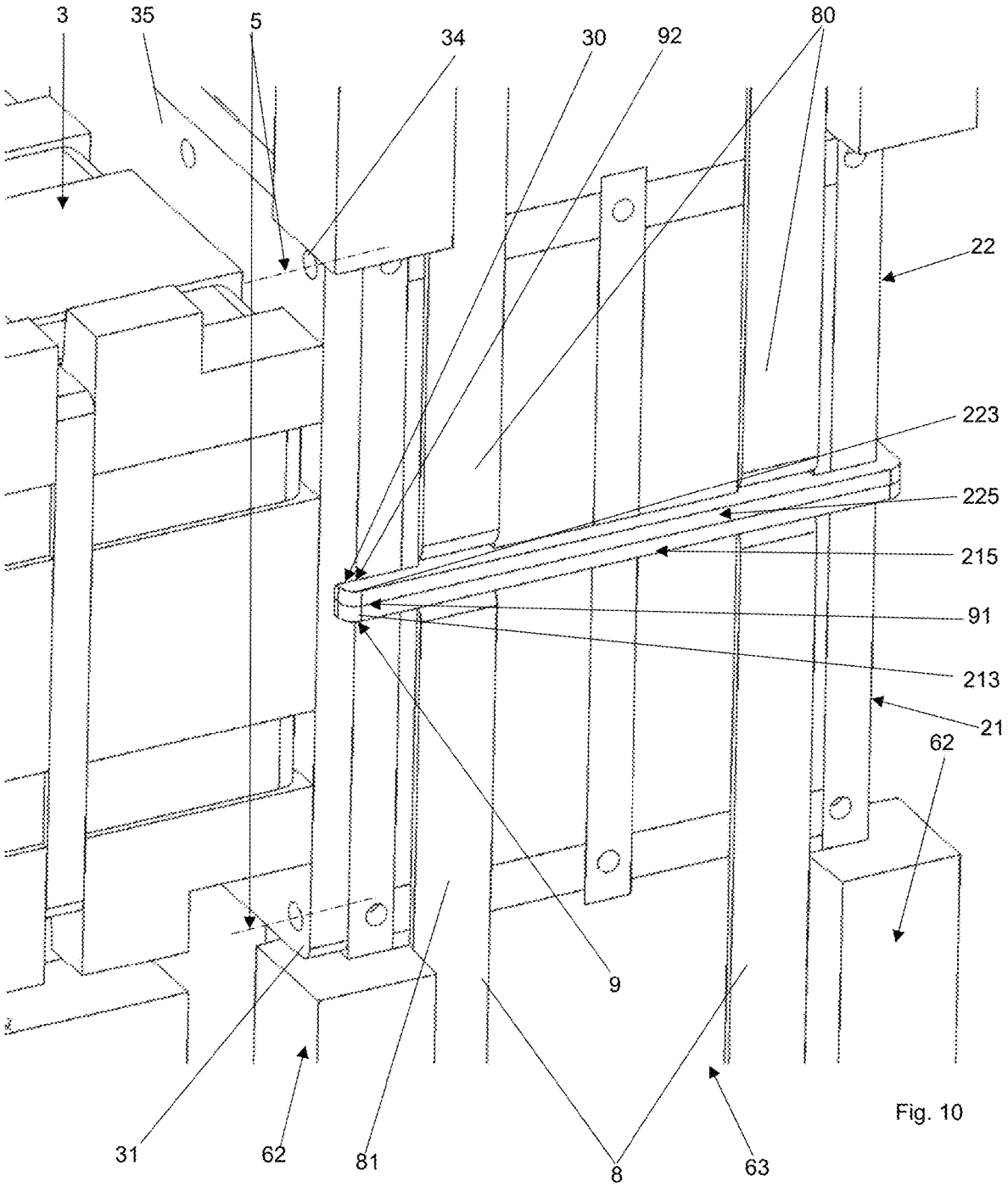
FIG. 10 shows a building structure having an alternative junction node with respect to that of FIGS. 1-9.

The structure 1 comprises reciprocal fixing means 9 for reciprocally fixing the first pillar 21, the second pillar 22 and the beam 3 (see for example FIGS. 9 and 10). The reciprocal fixing means 9 can be at least partly incorporated in the first pillar 21, in the second pillar 22, in the beam 3.

Thereby, the first pillar 21, the second pillar 22 and the beam 3 define a junction area defining a node. Suitably, several beams can lie on the same node (such beams are typically transverse, in particular orthogonal to one another; suitably they lie on the same horizontal plane). The first and the second pillar 21, 22 can therefore be in common between several incident vertical walls. The node is therefore a three-dimensional node. Suitably the node defines a hyperstatic joint.

The reciprocal fixing means 9 comprises projecting means 91 and corresponding housing means 92 in which the projecting means 91 fits defining a joint (see for example FIGS. 9 and 10). Suitably, the projecting means 91 and the housing means 92 are suitably counter-shaped. There can be a minimum clearance (for example a few millimetres) to facilitate insertion.

The projecting means 91 and the housing means 92 define male-female connections both between the first pillar 21 and the beam 3 and between the second pillar 22 and the beam 3.

Suitably, the projecting means 91 is obtained on both the first pillar 21 and on the second pillar 22. It fits in corresponding housing means 92 obtained on the beam 3.

Alternatively, the projecting means 91 (solution not shown) is obtained on the beam 3 while the housing means 92 is obtained on both the first and on the second pillar 21, 22.

In a further solution not illustrated, the projecting means 91 is obtained partly on the beam 3 and partly on the first pillar 21 while the housing means 92 is obtained partly on the beam 3 and partly on the second pillar 22.

In a further solution not illustrated, the projecting means 91 is obtained partly on the beam 3 and partly on the second pillar 22 while the housing means 92 is obtained partly on the beam 3 and partly on the first pillar 21.

As exemplified in the accompanying figures, the projecting means 91 comprises:

- a first protrusion 213 located at said upper end 211 and associated to the first pillar 21;
- a second protrusion 223 located at said lower end 221 and associated to the second pillar 22.

The first and the second protrusion 213, 223 project transversally with respect to the preponderant longitudinal extension direction 20. In particular the first and the second protrusion 213, 223 project horizontally. They can define flaps.

The housing means 92 comprises at a first end 31 of the beam 3 a slot 30.

The first and the second protrusion 213, 223 at least partially fit in the slot 30 at the first end 31.

In an alternative solution not shown, the first and the second protrusion 213, 223 could fit in different slots of the beam 3.

In the preferred solution, the first pillar 21 comprises:

- a first element 215 comprising said first protrusion 213;
- a first support 214 to which the first element 215 is removably connected.

As exemplified in FIG. 10, the first element 215 is a head plate of the first support 214. Such a plate is horizontal. The first protrusion 213 is an edge of the plate or a part of the edge of the plate. Suitably the first and the second protrusion 213, 223 are reciprocally in contact within the slot 30.

Figure 7:
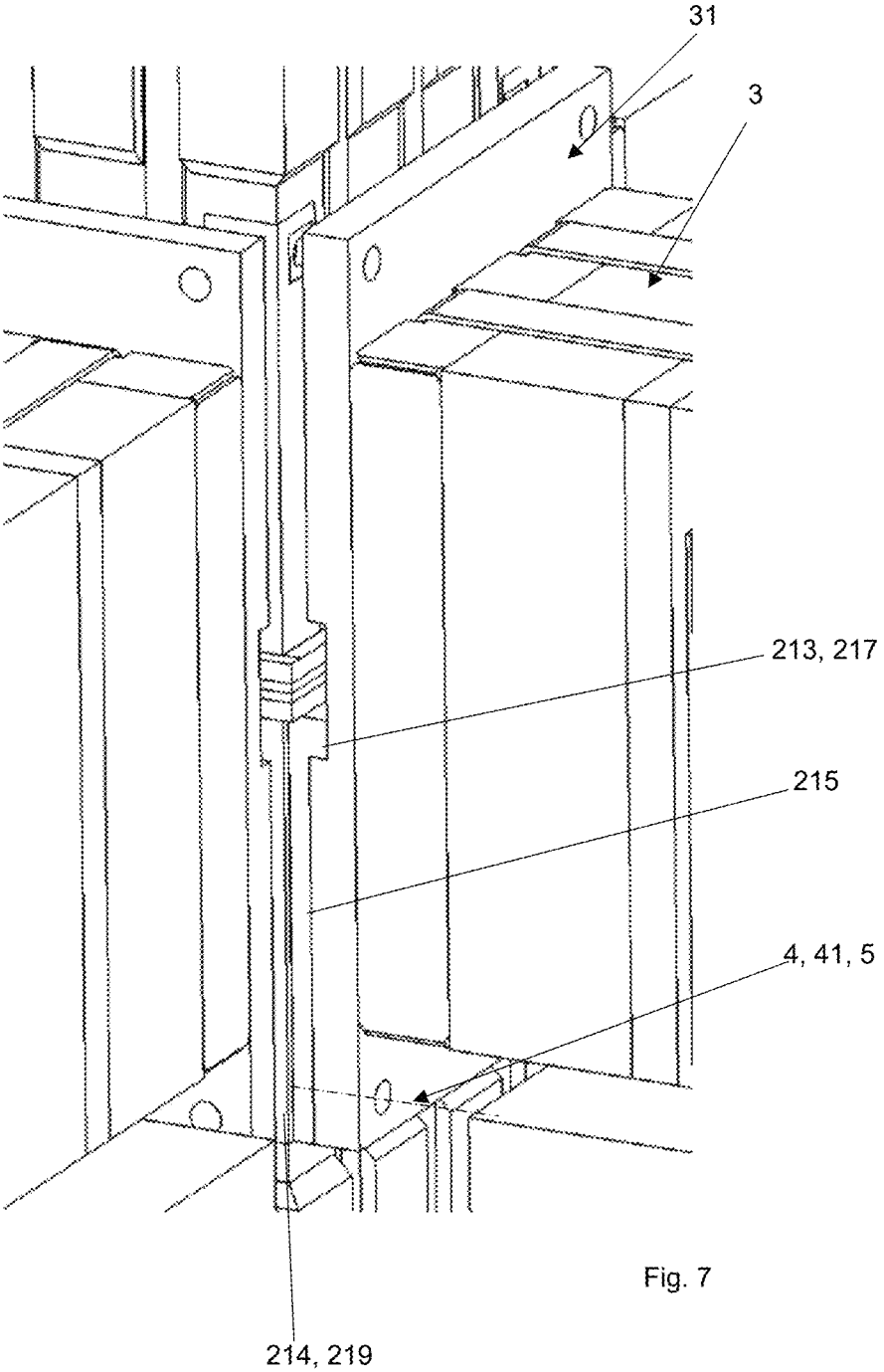
Figure 8:
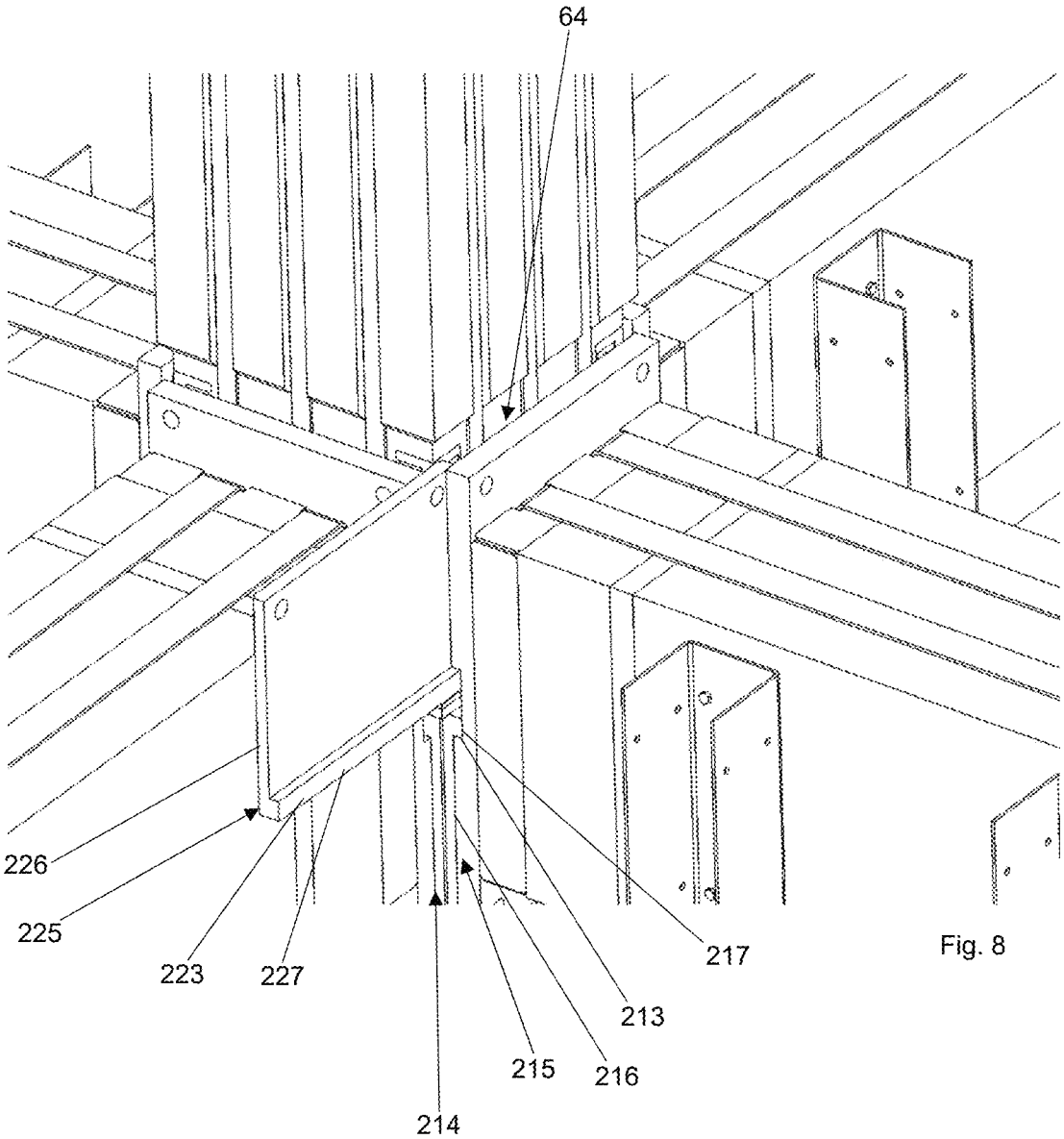

As exemplified in FIGS. 7-9, the first element 215 is an angle profile comprising:

- a first arm 216 which connects to the first support 214 along a lateral flank 219 of the first support 214;
- a second arm 217 which projects away from the first support 214 and in which said first protrusion 213 is made.

Suitably the first and the second element 215, 225 (or the first and the second protrusion 213, 223) are not reciprocally in contact in the slot 30. They contact at least opposite surfaces of the slot 30. Between the first and the second element 215, 225 (or the first and the second protrusion 213, 223) there are interposed end plates 218 of the first and the second pillar 21, 22 which extend transversally to the preponderant extension direction 20.

Advantageously, the first protrusion 213 protrudes with respect to the first support 214 along a direction transverse (preferably orthogonal) to the direction 20 of greater extension of the first pillar 21.

The structure 1 also comprises threaded connecting means 4 which connects the first element 215 (or in any case the first protrusion 213) and the first support 214. The solution of FIGS. 1-9 are schematically represented in FIG. 7. In the solution of FIG. 10, the means 4 is not displayed as it is hidden, but it is vertical screws which connect the first plate element 215 with the first pillar 21.

The first support 214 advantageously comprises at least one threaded housing forming part of the means 4; the first element 215 suitably comprises a through hole. The threaded connecting means 4 comprises at least a first screw 41 (advantageously a plurality of screws) which connects the first element 215 (and thus the first protrusion 213) to the first support 214. In this regard, preferably the first screw 41 transits in said through hole and comprises a threaded body which fits in said threaded housing. Suitably, the threaded connecting means 4 comprises a plurality of screws which transit in corresponding through holes of the first element 215 and fit in corresponding threaded housings of the first support 214.

Suitably what has been described with reference to the structure of the first pillar 21 can also be repeated for the second pillar 22.

Suitably the second pillar 22 comprises:

- a second element 225 comprising said second protrusion 223;
- a second support 224 to which the second element 225 is removably connected.

As exemplified in FIG. 10, the second element 225 is a head plate of the second support 224 (thus of the second pillar 22). Such a plate is horizontal. The second protrusion 223 is an edge of the plate.

In the solution in which several incident beams lie on the first and on the second pillar 21, 22 which lie on the same horizontal plane, the head plate (corresponding to the first element 215) of the first support 214 and the head plate (corresponding to the second element 225) of the second support 224 fit in both the slot 30 of the beam 3, but also in at least one other slot obtained on another of said incident beams (suitably each incident beam has its own slot in which the aforementioned head plates fit). Different peripheral edges of said head plates fit in the different slots. For example, such plates could be quadrilateral/polygonal and a first side of the quadrilateral fits in the slot 30 and a second side fits in a slot of another beam.

As exemplified in FIGS. 7-9 the second element 225 is an angle profile comprising:

- a first section 226 connecting to the second support 224 along a lateral flank of the second support 224;
- a second section 227 which projects away from the second support 224 and in which said second protrusion 223 is made.

Advantageously, the slot 30 has a preponderant extension direction. Suitably, the slot 30 extends horizontally. Suitably, the slot 30 extends in width orthogonally to said preponderant longitudinal direction.

The first and the second protrusion 213, 223 are superposed one on the other and are joined in the width of the slot 30. In a particular embodiment (see for example FIG. 10) the thickness of the first protrusion 213 added to the thickness of the second protrusion 223 is equal to the width of the slot 30.

Suitably the slot 30 accommodates only a peripheral flap of both the first and the second protrusion 213, 223.

Suitably, the beam 3 comprises an end plate 35 in which the slot 30 is obtained. The plate 35 is located in the first end 31.

The beam 3 (in particular the plate 35) comprises a plurality of holes 34; the structure 1 advantageously comprises threaded joining means 5 which crosses said holes 34 and inserts in threaded counter-shapings made in the first and the second pillar 21, 22. The joining means 5 comprises a plurality of threaded elements which insert in the corresponding holes 34 and in the corresponding threaded counter-shapings. Preferably the threaded joining means 5 is stressed by pure traction. There are thus no shear loads. Suitably, in the solution of FIGS. 1-9, the means 4 and the means 5 coincide. In the solution of FIG. 10, they are instead distinct.

As exemplified in FIG. 10, the structure 1 comprises enveloping means 8 which compresses said first pillar 21. It suitably exerts a post compression by winding. Thereby, the post-compression load can also be applied to the reciprocal fixing means 9. Suitably, the enveloping means 8 compresses the first pillar 21 along the longitudinal extension direction. The enveloping means 8 overlaps two opposite ends of the first pillar 21. Suitably, the enveloping means 8 can comprise a first enveloping 81 which transits in two bases and two opposite lateral flanks of the first pillar 21. The enveloping means 8 can comprise a second enveloping which affects the two bases and two further lateral flanks (distinct from the two mentioned just above) of the first pillar 21.

The enveloping means 8 can pass between the plate of the first element 215 and the first support 214.

The enveloping means 8 advantageously comprises a fibre-resin structure. In particular, it is a band. In the preferred solution the fibre is a glass fibre or a carbon fibre or a basalt fibre. Suitably, it is inert to corrosion and chemical attacks so that the durability of the elements is greatly increased.

The resin, for example, can be a polyester, vinyl ester, epoxy, polyurethane resin.

Suitably, the structure 1 can comprise enveloping means 80 which compresses the second pillar 22 (preferably along a preponderant extension direction). Suitably, the structure 1 can comprise enveloping means 800 which compresses the beam 3 (preferably along a preponderant extension of the beam 3).

Suitably, the first pillar 21, the second pillar 22 and the horizontal beam 3 are dry-connected without welds on site. They are also connected without having to make use of welds on site.

Suitably, the structure 1 comprises a wall 6 which lies in the plane identified by the first pillar 21 and by the beam 3. Such a wall 6 is suitably vertical. In particular, it is made of concrete. The wall 6 advantageously occludes (at least in part, preferably all) the space interposed between the first pillar 21 and the beam 3.

Suitably, the first pillar 21 has a lateral flank comprising parallel lateral flanks 62 which extend longitudinally along the preponderant direction 20 to house a portion of the wall 6. Suitably, the first pillar 21 has a quadrilateral shape and at each vertex of the quadrilateral it has longitudinal sides 62 which define four channels 63, one per flank. Suitably, the four channels 63 are intended to house at least one portion of a corresponding wall.

Suitably, the building structure 1 is modular. In particular, it comprises a plurality of pillars, beams, walls assembled together. Advantageously, what has been described with reference to the first pillar 21 can advantageously also be repeated for the second pillar 22. Suitably the first pillar 21 is identical to the second pillar 22.

Further subject matter of the present invention is a method for the assembly of a building structure 1 having one or more of the characteristics described previously. In particular, the method comprises the steps of:

- vertically positioning the first pillar 21 and an additional pillar 61, placing them at a predetermined distance from one another;
- positioning the wall 6 between the first pillar 21 and the additional pillar 61;
- positioning the beam 3 between the first pillar 21 and the additional pillar 61, placing it above the wall 6;
- positioning the second pillar 22 above the first pillar 21.

Suitably, the building structure 1 can be completed in the desired geometry, exploiting the modularity of the elements.

Suitably in the solution of FIGS. 1-9 the method comprises the step of inserting the first and the second protrusion 213, 223 in the slot 30, introducing two corresponding angle profiles comprising respectively the first and the second protrusion 213, 223 in cavities 64 which are between the first and the second pillar 21, 22 and the beam 3 already in position.

The present invention achieves important advantages.

Firstly, the nodes thus defined allow the transfer of very high specific moments without having to resort to connection casts or welds on site.

Furthermore, the production of prefabricated elements (pillars, beams) is facilitated, as they are free from protrusions which require specific moulds. The vertical loads supported by the horizontal beams can be transferred as compression and shear on the pillars. There are no shear loads on the screws.

The structure 1 can be incorporated with the post-compression and thereby the post-compression load is also applied to the fixing elements.

The invention as it is conceived is susceptible to numerous modifications and variants, all falling within the scope of the inventive concept characterised thereby. Furthermore, all the details can be replaced with other technically equivalent elements. In practice, all the materials used, as well as the dimensions, can be any whatsoever, according to need.

The invention claimed is:

1. A prefabricated building structure, comprising:

a first and a second pillar (21, 22) stacked and having a preponderant longitudinal extension direction (20);

an upper end (211) of the first pillar (21) being located at a lower end (221) of the second pillar (22);

a beam (3) extending substantially horizontally and having a first end (31) located at said upper end (211) and said lower end (221);

fixing means (9) for fixing the first pillar (21), the second pillar (22) and the beam (3); said fixing means (9) being able to be at least partly incorporated in the first pillar (21), in the second pillar (22), in the beam (3);

the fixing means (9) comprising projecting means (91) and corresponding housing means (92) in which the projecting means (91) fits defining a joint;

said projecting means (91) and said housing means (92) defining male-female connections both between the first pillar (21) and the beam (3) and between the second pillar (22) and the beam (3); characterised in that:

the structure comprises enveloping means (8); the enveloping means (8) comprising a fibre-resin band which compresses the first pillar (21) along the preponderant longitudinal extension direction (20) generating an axial compression force oriented along the preponderant longitudinal extension direction; the enveloping means (8) exerting a post compression by winding;

the first pillar (21), the second pillar (22) and the horizontal beam (3) are dry-connected without welds on site; and further casts are absent among the first pillar (21), the second pillar (22) and the horizontal beam (3).

2. The structure according to claim 1, characterised in that the projecting means (91) comprises:

a first protrusion (213) located at said upper end (211) and associated to the first pillar (21);

a second protrusion (223) located at said lower end (221) and associated to the second pillar (22);

the first and the second protrusion (213, 223) projecting transversally with respect to said preponderant longitudinal extension direction (20);

the housing means (92) comprising at the first end (31) of the beam (3) a slot (30);

the first and the second protrusion (213, 223) at least partially fitting in the slot (30) at the first end (31).

3. The structure according to claim 2, characterised in that said first pillar (21) comprises:

a first element (215) comprising said first protrusion (213);

a first support (214) to which the first element (215) is removably connected; said second pillar (22) comprises:

i) a second element (225) comprising said second protrusion (223);

ii) a second support (224) to which the second element (225) is removably connected.

4. The structure according to claim 3, characterised in that the first element (215) is a head plate of the first support (214) and the second element (225) is a head plate of the second support (224).

5. The structure according to claim 4, characterised in that the enveloping means (8) pass between the plate of the first element (215) and the first support (214).

6. The structure according to claim 3, characterised in that the first element (215) is an angle profile comprising:

a first arm (216) which connects to the first support (214) along a lateral flank (219) of the first support (214);

a second arm (217) which projects away from the first support (214) and in which said first protrusion (213) is made;

the second element (225) being an angle profile comprising:

i) a first portion (226) which connects laterally to the second support (224);

ii) a second portion (227) which projects away from the second support (224) and in which said second protrusion (223) is made.

7. The structure according to claim 2, characterised in that said slot (30) has a preponderant longitudinal direction and extending in width orthogonally to said preponderant extension direction; the first and the second protrusion (213, 223) being superposed one on the other and being joined in the width of the slot (30).

8. The structure according to claim 1, characterised in that said beam (3) comprises a plurality of holes (34); said structure comprising threaded joining means (5) which crosses said holes (34) and which inserts in threaded counter-shapings made in the first and the second pillar (21, 22); said threaded joining means (5) being stressed by pure traction.

9. The structure according to claim 1, characterised in that it comprises a concrete vertical wall (6) which lies in the plane identified by the first pillar (21) and by the beam (3) and which occludes the space interposed between the first pillar (21) and the beam (3).

* * * * *